United States Patent [19]

Goderbauer

[11] 4,053,107

[45] Oct. 11, 1977

[54] DEVICE FOR FASTENING A RAIL TO A SLEEPER, HOLDER AND CLIP FOR THE APPLICATION OF SUCH A FASTENING DEVICE

[76] Inventor: Lodewijk Goderbauer, van Lommessenweg 1, Schaesberg, Netherlands

[21] Appl. No.: 667,698

[22] Filed: Mar. 17, 1976

[30] Foreign Application Priority Data

Mar. 24, 1975 Netherlands ..... 7503503

[51] Int. Cl.[2] ..... E01B 9/30; E01B 9/34; E01B 9/48

[52] U.S. Cl. ..... 238/349; 238/338; 238/351

[58] Field of Search ..... 238/351, 349, 310, 378, 238/338, 315, 331, 343

[56] References Cited

U.S. PATENT DOCUMENTS

| | | | |
|---|---|---|---|
| 3,067,947 | 12/1962 | Deenik et al. | 238/349 X |
| 3,395,864 | 8/1968 | Kuster | 238/310 |
| 3,696,998 | 10/1972 | Bhaskaran | 238/349 |

FOREIGN PATENT DOCUMENTS

| | | | |
|---|---|---|---|
| 844,019 | 7/1952 | Germany | 238/310 |
| 781,406 | 8/1957 | United Kingdom | 238/351 |

*Primary Examiner*—Robert J. Spar
*Assistant Examiner*—Randolph A. Reese
*Attorney, Agent, or Firm*—Snyder, Brown & Ramik

[57] ABSTRACT

A fastening device for a rail to a cross tie comprising a resilient, double C-clip and an appropriate holder having a passage in which the loop-like portion of the clip can be supported for producing the fastening force, wherein the clip portion bearing on the rail foot extends by at least one free end beyond the edges of the rail foot and wherein on the side facing the rail the holder has faces located in the path of at least one free end of the clip, when the latter is bent too far outwardly for releasing the foot of the rail and a holder and a clip for use in said fastening device.

18 Claims, 5 Drawing Figures

FIG.1
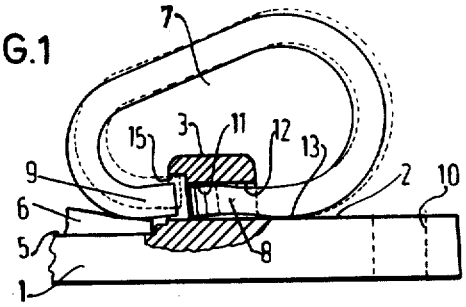
FIG.5
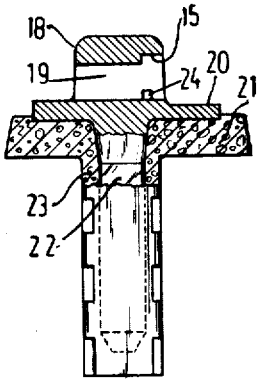
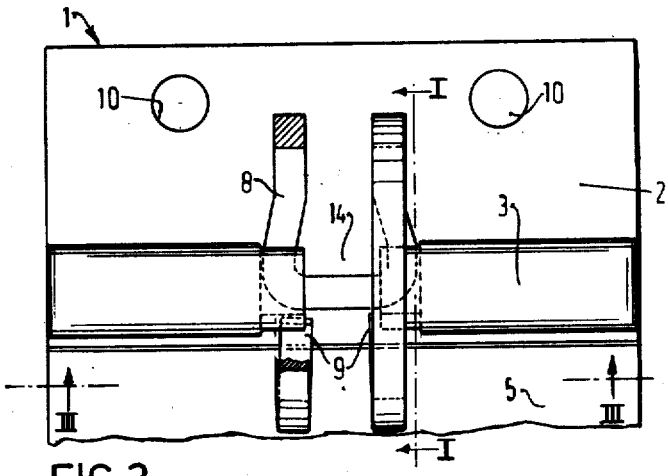
FIG.2
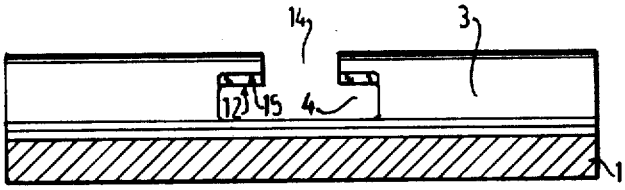
FIG.3
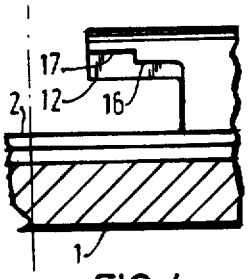
FIG.4

DEVICE FOR FASTENING A RAIL TO A SLEEPER, HOLDER AND CLIP FOR THE APPLICATION OF SUCH A FASTENING DEVICE

The invention relates to a device for fastening a rail to a cross tie, comprising a resilient double-C clip and an appropriate holder having a passage in which the loop-like portion of the clip can be supported for providing the fixing force. Such fastening devices are suitable for securing rails to wooden as well as to concrete cross ties and they may furthermore be employed for securing rails, for example, to a steel bed track as in the case of a bridge, a viaduct or a tunnel. The resilient clip has to absorb heavy forces since the rail is heavily loaded by passing trains and in particular in aligning a rail very heavy forces and impulses may be exerted on the fastening device.

The invention has for its object to provide a fastening device of the kind set forth, which is capable of absorbing heavy forces and impulses without the need for using an excessively heavy clip, while in addition means are provided for avoiding overload of the clip in operation.

According to the invention the clip portion bearing on the rail foot may extend by at least one free end beyond the edges of the rail foot, while on the side facing the rail the holder may have faces located in the path of at least one free end of the clip, when said ends are deflected too far outwardly in the operational state, for example, for releasing the rail foot. In this way an excessive deformation of the clip in an upward direction is very effectively avoided. This is particularly important if it is desired to lift the clip in a given position, without dismounting it, for example, in order to relieve the rail in the direction of length of the track. The faces determining the pressing force of the clip on the rail foot are in this case completely independent of the faces limiting the resilient deflection of at least one free end of the clip in the upward direction. The path of deflection can be limited so that in operation the clip has a freedom of deflection lying within the elasticity part of the characteristic resilience. In the event of overload, that is to say, in the event of a load tending to produce a larger deformation than that corresponding to said freedom of deflection, the prolonged limbs of the clip strike the boundary faces so that permanent deformation of the clip is prevented.

According to the invention the upper wall of the passage in the holder can be constructed in steps in a direction transverse of the rail, the lower part of each step forming a supporting face for the clip portion located in the passage and the higher part forming a boundary face for the upward displacement of at least one free end of the clip in the operational state thereof. The desired boundary face is then obtained in a particularly simple manner.

According to the invention each boundary face for the upward displacement of at least one free end of the clip may have, in a direction transverse of the axis of the passage, parts located at different heights relative to the lowermost supporting face. This permits of selecting among various boundary faces by bending the free ends of the clip to a greater or lesser extent away from one another after the clip has been mounted. The free ends may even be disposed in a given, desired position during manufacture.

According to the invention the boundary faces located at different heights may merge one in the other in a stepwise fashion. In this way a well-defined boundary face is obtained for each relative position of the free ends of the clip.

According to the invention the passage may have a lug at the end facing the rail to form a stop for the clip end inserted into said passage. It is then ensured that the clip will occupy the correct position since at least one free end will come into contact with said boundary faces.

According to the invention the clip portion located in the holder is arcuated upwardly, the topmost point of the arcuated portion engaging the topmost supporting face of the holder. Such a structure of the fastening device permits of fully utilizing the power of absorbing a given moment, since then the leverage is accurately defined without the need for machining the passage and the clip portion to be inserted therein with small tolerances. Even in the case of given discrepancies in dimensions and accuracy of machining the distance between the contact points invariably maintains substantially the same value.

According to the invention the arcuated clip portion may be supported on the lower side from a part of the supporting face which is located at a given distance from the side of the passage of the holder remote from the rail. This permits of using a greater leverage, which is advantageous for absorbing a heavy load, while the dimensions of the clip remain the same. The clip is thus less sensitive to discrepancies in dimensions, while wear is reduced.

The invention furthermore relates to a holder for use in the fastening device described above. The holder according to the invention may have additional faces on the rail-facing side of the upper supporting faces for limiting the upward movement of at least one free end of a clip mounted in said holder.

According to the invention the upper walls of the passage of the holder may have a stepwise shape in the direction of the axis of said passage, the lowermost part of each step forming a supporting face for a clip to be mounted in said holder and the topmost part forming a boundary face for the upward displacement of at least one free end of said clip.

According to the invention each boundary face for the upward displacement of at least one free end of a clip mounted in said holder may have in a direction transverse of the axis of the passage, parts located at different heights relative to the lowermost supporting face.

According to the invention the boundary faces of the holder located at different heights may merge one in the other in stepwise fashion.

According to the invention the lower face of the passage may have an upright lug at the end facing the rail.

The lower face of the passage of a holder according to the invention may have a prolonged supporting face on the side remote from the location of the rail.

Finally the invention also relates to a clip for use in any of the fastening devices described above.

According to the invention at least one end of the clip intended to bear on the rail foot has a prolongation. In a given embodiment the portion of the clip to be mounted in the passage may be arcuated upwardly.

The invention will now be described more fully with reference to the drawing of one embodiment.

In the drawing:

FIG. 1 shows a fastening device in accordance with the invention in a cross sectional view normal to the rail taken on the line I—I in FIG. 2, FIG. 2 is a plan view of the fastening device of FIG. 1, FIG. 3 is a sectional view of the holder of FIG. 2 taken on the line III—III in FIG. 2, FIG. 4 shows a detail of FIG. 3 in a different embodiment, FIG. 5 is a schematic sectional view like FIG. 1 of a holder in a different embodiment.

The holder shown in FIG. 1 to 3 comprises a plate 1 having a supporting face 2 and a ridge-shaped portion 3 having a passage 4. The plate 1 has a location 5 for the foot 6 of a rail (not shown). The loop-like portion 8 of a double-C clip 7 is located in the passage 4, whereas the free ends 9 of the clip 7 bear on the foot of the rail 6. The plate 1 has holes 10 for securing it to a cross tie (not shown). The loop-like portion 8 of the clip 7 is arcuated upwardly (see FIG. 1). At the topmost point 11 of said arcuated portion the clip is in contact with the upper wall 12 of the passage 4 in the holder. At the lowermost part the loop-like portion is located at point 13 on the supporting face 2 of the holder. This supporting face extends beyond the passage 4 so that the distance between the points 11 and 13 determines the magnitude of the leverage for absorbing the moment to be exerted by the clip. It will be obvious that irrespective of the accuracy of machining of the faces of the passage 4 and of the loop-like portion of the clip said points of location 11 and 13 will invariably occupy substantially the same relative positions. Since the ridge shaped portion has an interruption 14 at the center of the passage 4, the clip can be readily mounted by slipping the loop-like portion 8 in downward direction (see FIG. 2) into the passage, while the free ends 9 are pinched towards one another so that they can pass the ridge 3 through the free space 14.

On the side of the holder facing the bottom of the rail the passage has an upper face 15, which constitutes a boundary for the upward movement of the free ends 9 of the clip 7. A broken line indicates the free ends 9 of the clip 7 striking the faces 15 in their upward movement. Thus overload of the clip in the event of excessive deformation in the operational state is avoided.

FIG. 4 shows a slightly different shape of the passage. Instead of one face 15 two faces 16 and 17 are located at different heights relative to the supporting face 2. By spacing the free ends 9 of the clip 7 by a greater or smaller distance from one another, the boundary faces may be optionally formed by the faces 16 and 17. Thus the same or substantially the same clip may be employed for different conditions determined by the shape of the holder.

FIG. 5 illustrates a different type of holder which is particularly suitable for use in conjunction with a concrete cross tie. A housing 18 having a passage 19 forms part of a metal bottom plate 20. The bottom plate 20 is embedded in a layer of synthetic mortar 21 joining the housing all around by a horizontal top face. The housing furthermore has anchoring parts 22, which are also surrounded by a layer of synthetic mortar 23. The structure of the passage and of the various supporting faces completely corresponds with that shown in FIGS. 1 to 3. Instead of using synthetic mortar other insulating material or a sleeve of the desired properties may be employed.

FIG. 5 shows furthermore that, if desired, a lug 24 may be provided in the passage 19 on the side of the rail. When the clip is inserted into the passage, it strikes the lug operating as a stop so that the clip will safely occupy the correct positon, it being ensured that the free ends of the clip, when excessively bent away from one another are retained by the faces 15.

What I claim is:

1. A device for fastening a rail to a cross tie, comprising in combination:

a holder adapted to be secured to a cross tie, said holder having a portion for underlying a rail foot and an upstanding portion adjacent the rail foot, said upstanding portion defining a recess facing the rail and a recess facing away from the rail; and a spring clip cooperating with said holder to press downwardly on the rail foot, said clip comprising first and second C-shaped portions disposed in spaced, side-by-side upstanding relation, and a bight portion joining such C-shaped portions at one of their ends so as to leave the opposite ends of said C-shaped portions free, said free ends of the C-shaped portions being directed toward but spaced from said bight portion with such spacing being less than the width of the upstanding portion of said holder, and said free ends being received in that recess adjacent the rail foot and extending outwardly therefrom to bear downwardly upon the rail foot while said bight portion is received in the other recess, said recess adjacent the rail foot being of a height which provides clearance over said free ends whereby said free ends may be deformed upwardly only to a limited extent.

2. A device as defined in claim 1 wherein the height of said recess adjacent the rail foot is greater than the height of the other recess.

3. A device as defined in claim 2 wherein the height of said recess adjacent the rail foot is stepped to provide different clearance heights dependent upon the spacing between said free ends of the clip.

4. A device as defined in claim 3 wherein said recesses intersect each other to provide a passage through said upstanding portion of the holder.

5. A device as defined in claim 2 wherein said recesses intersect each other to provide a passage through said upstanding portion of the holder.

6. A device as defined in claim 1 wherein said recesses intersect each other to provide a passage through said upstanding portion of the holder.

7. A device as defined in claim 1 wherein those ends of the C-shaped clips which are joined by said bight portion are arched so that said clips bear downwardly on the holder outside the confines of said upstanding portion.

8. A device for fastening a rail to a cross tie comprising, in combination:

a holder having a portion adapted to underlie a rail foot and an upstanding portion adjacent the rail foot, said upstanding portion having an inverted T-shaped passage extending transversely thereof to define a floor and overhanging portions spaced above said floor and extending toward one another; and a clip cooperating with said holder to bear downwardly on the rail foot, said clip comprising a pair of C-shaped portions each having a free end portion and an opposite end portion, and a bight portion joining said opposite end portions to maintain said C-shaped portions in horizontally spaced, side-by-side relation, the width of said clip at said bight portion being greater than the spacing between said overhanging portions of the holder and being disposed thereunder to bear upon said floor, and said free ends of the C-shaped clip portions being directed toward said bight portion and spaced therefrom by a distance less than the transverse length of said passage, whereby said free ends bear downwardly upon the rail foot and project into said passage below said overhanging portions.

9. A device as defined in claim 8 including a stop upstanding from said floor to prevent too deep penetration of said bight portion within said passage.

10. A device as defined in claim 9 wherein those ends of the C-shaped clips which are joined by said bight portion are arched so that said clips bear downwardly on the holder outside the confines of said upstanding portion.

11. A device as defined in claim 10 wherein the spacing between said overhanging portions is sufficient to accommodate said free ends of the C-shaped portions when they are squeezed together.

12. A device as defined in claim 8 wherein the overhanging portions of the holder are stepped transversely of the holder to provide clearance above said free ends of the C-shaped portions of the clip.

13. A device as defined in claim 12 wherein each overhanging portion is longitudinally stepped to provide different clearance heights above said free ends dependent upon the spacing therebetween.

14. A device as defined in claim 12 wherein those ends of the C-shaped clips which are joined by said bight portion are arched so that said clips bear downwardly on the holder outside the confines of said upstanding portion.

15. A device as defined in claim 14 wherein the spacing between said overhanging portions is sufficient to accommodate said free ends of the C-shaped portions when they are squeezed together.

16. A device as defined in claim 8 wherein the spacing between said overhanging portions is sufficient to accommodate said free ends of the C-shaped portions when they are squeezed together.

17. A device as defined in claim 8 wherein those ends of the C-shaped clips which are joined by said bight portion are arched so that said clips bear downwardly on the holder outside the confines of said upstanding portion.

18. A device as defined in claim 17 wherein the spacing between said overhanging portions is sufficient to accommodate said free ends of the C-shaped portions when they are squeezed together.

* * * * *